US011832644B2

(12) United States Patent
Saettone et al.

(10) Patent No.: US 11,832,644 B2
(45) Date of Patent: Dec. 5, 2023

(54) PROCESSES FOR PRODUCING FILTER ELEMENTS SUITABLE FOR USE IN SMOKING ARTICLES

(71) Applicant: BIO-ON S.p.A., San Giorgio di Piano (IT)

(72) Inventors: Paolo Saettone, San Giorgio di Piano (IT); Ilaria Monaco, San Giorgio di Piano (IT); Thomas M. Holsen, Potsdam, NY (US); Mohammad Arifur Rahman, Potsdam, NY (US); Philip K. Hopke, Potsdam, NY (US); Mauro Comes Franchini, San Giorgio di Piano (IT)

(73) Assignee: BIO-ON S.p.A., San Giorgio di Piano (IT)

( * ) Notice: Subject to any disclaimer, the term of this patent is extended or adjusted under 35 U.S.C. 154(b) by 0 days.

(21) Appl. No.: 17/853,444

(22) Filed: Jun. 29, 2022

(65) Prior Publication Data

US 2022/0322737 A1 Oct. 13, 2022

Related U.S. Application Data

(62) Division of application No. 16/428,507, filed on May 31, 2019, now abandoned.

(51) Int. Cl.
*A24D 3/14* (2006.01)
*A24D 3/02* (2006.01)
(Continued)

(52) U.S. Cl.
CPC ..... *A24D 3/14* (2013.01); *A24D 3/0229* (2013.01); *A24D 3/0254* (2013.01); *A24D 3/063* (2013.01); *A24D 3/068* (2013.01); *A24D 3/10* (2013.01)

(58) Field of Classification Search
CPC ..... A24D 3/14; A24D 3/0229; A24D 3/0254; A24D 3/063; A24D 3/10
See application file for complete search history.

(56) References Cited

U.S. PATENT DOCUMENTS 4,355,995 A * 10/1982 Berger ..... A24D 3/043 493/43
4,579,130 A * 4/1986 Coffman ..... A24D 3/08 131/345
(Continued)

FOREIGN PATENT DOCUMENTS

WO 1999/023146 A1 5/1999
WO 2011/019646 A1 2/2011
(Continued)

OTHER PUBLICATIONS

Zhao et al., "Concentration of Reactive Oxygen Species (ROS) in Mainstream and Sidestream Cigarette Smoke," Aerosol Science and Technology, pp. 191-197 (2012).
(Continued)

*Primary Examiner* — Linda L Gray
(74) *Attorney, Agent, or Firm* — MH2 TECHNOLOGY LAW GROUP LLP

(57) ABSTRACT

A process for producing a filter element suitable for use in smoking articles may include: embedding a bundle of cellulose acetate fibers with an aqueous suspension of polyhydroxyalkanoate (PHA) to obtain a wet bundle of the cellulose acetate fibers covered by the aqueous suspension of the PHA; shaping the wet bundle in a form of a continuous elongated element; heating the continuous elongated element to temperature greater than or equal to 140° C. and less than or equal to 180° C. for time sufficient to melt the PHA and to evaporate water from the continuous elongated element; cooling the heated continuous elongated element to
(Continued)

obtain crystallization of the PHA; and cutting the so-obtained continuous elongated element into segments of predetermined length.

20 Claims, 1 Drawing Sheet

(51) Int. Cl.
*A24D 3/06* (2006.01)
*A24D 3/10* (2006.01)

(56) References Cited

U.S. PATENT DOCUMENTS

| | | | |
|---|---|---|---|
| 5,913,311 | A | 6/1999 | Ito et al. |
| 5,947,126 | A | 9/1999 | Wilson et al. |
| 5,970,988 | A | 10/1999 | Buchanan et al. |
| 6,344,239 | B1 | 2/2002 | Asai et al. |
| 6,571,802 | B1 | 6/2003 | Yamashita |
| 8,950,407 | B2 | 2/2015 | Sebastian et al. |
| 8,956,835 | B2 | 2/2015 | Nakas et al. |
| 9,032,970 | B2 | 5/2015 | Szarvas |
| 2012/0000479 | A1 | 1/2012 | Sebastian et al. |
| 2012/0160255 | A1 | 6/2012 | Ghanavi |
| 2014/0096783 | A1 | 4/2014 | Sebastian et al. |
| 2014/0163169 | A1 | 6/2014 | Kitagawa et al. |
| 2015/0125504 | A1 | 5/2015 | Ward et al. |
| 2017/0354179 | A1 | 12/2017 | Sebastian et al. |

FOREIGN PATENT DOCUMENTS

| | | | |
|---|---|---|---|
| WO | 2011/045625 | A1 | 4/2011 |
| WO | 2015/015395 | A1 | 2/2015 |
| WO | 2015/110803 | A1 | 7/2015 |

OTHER PUBLICATIONS

Rahman et al., "Assessment of Methods for the Measurement of Wood Fuel Compositions," American Chemical Society, Energy Fuels, pp. 5215-5221 (2017).

International Search Report and Written Opinion dated Aug. 19, 2020, in corresponding International Application No. PCT/IB2020/055029, 11 pages.

Vreeke et al. "Triacetin Enhances Levels of Acrolein, Formaldehyde Hemiacetals, and Acetaldehyde in Electronic Cigarette Aerosols," ACS Omega, vol. 3, No. 7, pp. 7165-7170 (Jul. 2, 2018).

* cited by examiner

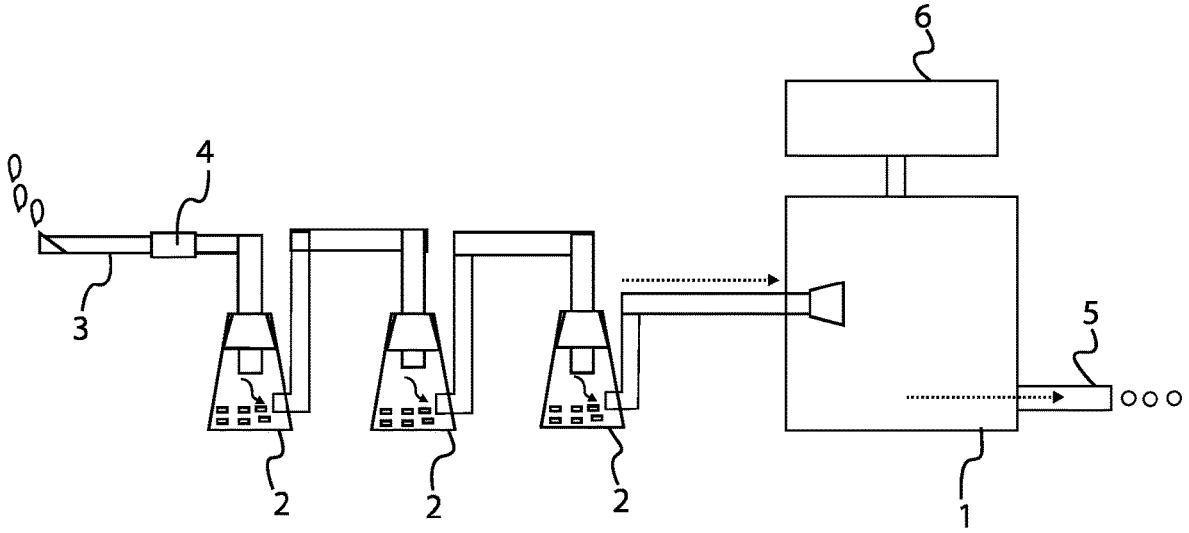
6
4
3
5
2
2
2
1

PROCESSES FOR PRODUCING FILTER ELEMENTS SUITABLE FOR USE IN SMOKING ARTICLES

CROSS-REFERENCE TO RELATED APPLICATION(S)

This application is a divisional application of pending U.S. patent application Ser. No. 16/428,507 ("the '507 application"), filed on May 31, 2019, in the U.S. Patent and Trademark Office ("USPTO"), and published as U.S. Patent Publication No. 2020/0375245 A1 on Dec. 3, 2020. The entire contents of these application(s) and publication(s) are incorporated herein by reference.

BACKGROUND OF THE INVENTION

The present invention relates to a filter element suitable for use in a smoking article and to a process for producing the same. More particularly, the present invention relates to a filter element suitable for use in a smoking article and to a process for producing the same, wherein the filter element comprises a bundle of fibers bonded by a biodegradable material, particularly a polyhydroxyalkanoate (PHA).

Smoking articles, such as cigarettes, usually have a substantially cylindrical rod-shaped structure and include a roll of smokable material, such as shredded tobacco, surrounded by a paper wrapper, thereby forming a so-called "smokable rod". Normally, a cigarette has a cylindrical filter element aligned in an end-to-end relationship with the smokable rod. Typically, a filter element comprises a bundle of cellulose acetate fibers circumscribed by a paper material and the filter element is attached to one end of the smokable rod using a circumscribing wrapping material known as "tipping material". Conventional cellulose acetate fibers (which are produced in the form of a bundle, known also as "tow") are bound with an appropriate plasticizer, usually glyceryl triacetate (triacetin), which is able to bond the staple fibers to one another to produce a relatively firm and rigid structure that does not soften or collapse during smoking.

As regards environmental sustainability, the currently available filter technology for forming filter elements has several drawbacks. For example, conventional filter elements comprising cellulose acetate fibers bonded by triacetin require an undesirably long time to actually biodegrade (usually on the order of two to ten years). Certain filter elements for cigarettes have been developed that contain materials that may promote biodegradation of filter elements after use. For example, certain additives have been noted which can be added to filter materials to enhance degradability (see, for example, U.S. Pat. Nos. 5,913,311, 5,947,126, 5,970,988 and 6,571,802).

US 2017/0354179 discloses smoking articles including filter elements formed from two or more fibrous inputs with different physical properties. A first plurality of staple cellulose acetate fibers and a second plurality of degradable polymeric staple fibers are blended to give a fiber mixture, wherein the staple fibers of the fiber mixture are randomly oriented. The degradable polymeric staple fibers can be treated to increase hydrophobicity. The staple fibers of the fiber mixture can then be bonded to form a fibrous bundle that can be incorporated into a filter element. Exemplary biodegradable materials for the degradable staple fibers include aliphatic polyesters, cellulose acetate with embedded starch particles, cellulose coated with acetyl groups, polyvinyl alcohol, starch, polybutylene succinate, proteins, polysaccharides (e.g., cellulose and/or calcium alginate), and copolymers and blends thereof. Exemplary aliphatic polyesters have the structure —[C(O)—R—O]n-, wherein n is an integer representing the number of monomer units in the polymer chain and R is an aliphatic hydrocarbon, preferably a $C_1$-$C_{10}$ alkylene, more preferably a $C_1$-$C_6$ alkylene, having a straight or branched chain. Exemplary aliphatic polyesters include polyglycolic acid (PGA), polylactic acid (PLA) (e.g., poly(L-lactic acid) or poly(DL-lactic acid)), polyhydroxyalkanoates (PHAs) such as polyhydroxypropionate, polyhydroxyvalerate, polyhydroxybutyrate, polyhydroxyhexanoate, and polyhydroxyoctanoate, polycaprolactone (PCL), polybutylene succinate, polybutylene succinate adipate, and copolymers thereof (e.g., polyhydroxybutyrate-co-hydroxyvalerate (PHBV)).

Another problem that has been faced for a long time by the cigarette manufacturers is that of providing filter elements that are more effective in absorbing the toxic components of the cigarette smoke, so as to reduce the well known risks to human health caused by the several byproducts that are produced by tobacco and paper burning, such as polycyclic aromatic hydrocarbons (PAH), heavy metals, reactive oxygen species (ROS), and many others.

For instance, US 2012/0160255 discloses an electrospun fiber mat cigarette filter for removing toxic compounds from a cigarette smoke, which comprises a biological macromolecule, a plurality of additives, a solvent, and an acceptable polymeric carrier. The biological macromolecule comprises polynuclear complexes with polymetal ions and a combination thereof. The polynuclear complexes are polyporphyrin rings and the polymetal ions include ferrous ions, cuprous ions, manganese ions and zinc ions. The biological macromolecule is selected from a group consisting of an engineered polyhemoglobin and/or chlorophyll.

U.S. Pat. No. 9,032,970 discloses a cigarette filter for decreasing the amount of $Po^{210}$, polycyclic aromatic hydrocarbons (PAH), heavy metal elements, and free radicals in the cigarette smoke, wherein the filter contains, in addition to the common components of known cigarette filters, $AlOHH \cdot H_2O$, and/or $Al_2O_3$ and/or silicoaluminate and grape pip and skin grist as antioxidants, and optionally astaxanthin and/or cranberry as further antioxidants.

SUMMARY OF THE INVENTION

The Applicant has faced the problem of improving biodegradability of filter elements to be used in smoking articles, especially cigarettes, by using biodegradable materials that do not require modifications of the manufacturing process in an unacceptable way for industrial production and that guarantees adequate properties in terms of mechanical resistance during manufacturing of the filter elements with plants working at high speeds, resistance to heating during smoking, while still providing the desirable taste and filtration properties associated with conventional cigarette filters.

The Applicant has found that the above technical problem and others that are better illustrated herein below can be solved by using as bonding agent for cellulose acetate fibers, instead of triacetin or other bonding agents, a polyhydroxyalkanoate (PHA), which is a highly biodegradable polymer that is able to bond the cellulose acetate fibers when applied on the fiber surface, causing the formation of random connection points to retain a space between the fibers suitable for a correct pressure drop during smoking and to impart a suitable hardness to the filter element. Moreover, since the PHA has a relatively high melting point and is substantially insoluble in water, it does not soften or melt when it is subjected to the warm and humid smoke produced during cigarette smoking, so as to prevent softening or collapsing of the filter element during smoking.

Moreover, the Applicant has found that the presence of a PHA on the surface of the cellulose acetate fibers forming the filter element causes a remarkable reduction of toxic substances in the cigarette smoke, especially as regards reactive oxygen species (ROS). Therefore, the filter element according to the present invention, besides being more biodegradable with respect to conventional filter elements, is particularly effective in reducing the risks for the smokers' health by quenching the ROS that are present in the cigarette smoke.

It is well known that ROS are toxic to cells, being responsible for oxidative stress. More than a hundred diseases are related to ROS, such as diabetes, inflammatory immunization injuries, autoimmune systemic diseases, organizational injuries resulting from blood loss and cancer.

Therefore, according to a first aspect, the present invention relates to a filter element suitable for use in a smoking article, which comprises cellulose acetate fibers bonded together by means of a polyhydroxyalkanoate (PHA) surrounding the cellulose acetate fibers.

According to a second aspect, the present invention relates to a process for producing a filter element suitable for use in a smoking article, which comprises:

- embedding a bundle of cellulose acetate fibers with an aqueous suspension of a PHA to obtain a wet bundle of cellulose acetate fibers covered by the PHA suspension;
- shaping the wet bundle in the form of a continuous elongated element;
- heating the continuous elongated element to a temperature of from 140° C. to 180° C. for a time sufficient to melt the PHA and evaporate the water;
- cooling the heated continuous elongated element to obtain crystallization of the PHA;
- cutting the so obtained continuous elongated element into segments of a predetermined length.

According to another aspect, the present invention relates to a method for quenching reactive oxygen species (ROS) in the smoke produced by a smoking article, wherein the method includes providing the smoking article with a filter element as defined above.

According to another aspect, the present invention relates to the use of a filter element inserted in a smoking article as defined above for quenching reactive oxygen species (ROS) in the smoke produced by the smoking article.

For the purpose of the present description and of the claims that follow, except where otherwise indicated, all numbers expressing amounts, quantities, percentages, and so forth, are to be understood as being modified in all instances by the term "about". Moreover, all ranges include any combination of the maximum and minimum points disclosed and include any intermediate ranges therein, which may or may not be specifically enumerated herein.

As regards the smoking article, according to the present invention the term includes not only conventional cigarettes that are smoked by burning at high temperatures, but also smoking systems which have been recently put on the market, conventionally known as "heat-not-burn tobacco" systems, where the tobacco rod is not burnt but only heated to generate an aerosol that contains nicotine and other chemicals (such the IQOS™ kit by Philip Morris). In such systems a sort of cigarette of small dimensions including a tobacco rod is used, which have different filtering means, including also filter elements usually made from cellulose acetate filters bonded by triacetin. While in conventional cigarettes the filter element has generally a length of about 2.3 cm, in the "cigarettes" to be used for "heat-not-burn tobacco" systems, the filter elements have generally a length of about 0.5 cm.

As regards the cellulose acetate fibers that can be used in the filter element according to the present invention, they are well known in the field of cigarette manufacturing. They are typically in the form of a continuous filament, generally having a diameter, expressed as denier per filament (dpf), from 1 to 15, more preferably from 5 to 10. Denier per filament (dpf) is a measurement of the weight per unit length of the individual filaments of the fibers, specifically grams/9000 meters. The shape of the individual filament cross-sections can vary and can be, for instance, a rectangular, circular, oblong, or multilobal shape.

The bundle of cellulose acetate fibers typically has a total denier in the range of from 20,000 denier to 80,000 denier, preferably from 30,000 denier to 60,000 denier.

Preferably, the PHA according to the present invention is a polymer containing repeating units of formula (I):

$$—O—CHR_1—(CH_2)_n—CO— \quad (I)$$

where:

$R_1$ is selected from: $C_1$-$C_{12}$ alkyls, $C_4$-$C_{16}$ cycloalkyls, $C_2$-$C_{12}$ alkenyls, optionally substituted with at least one group selected from: halogen (F, Cl, Br), —CN, —OH, —OOH, —OR, —COOR (R=$C_1$-$C_4$ alkyl, benzyl);

n is zero or is an integer from 1 to 6, preferably is 1 or 2.

Preferably, $R_1$ is methyl or ethyl, and n is 1 or 2.

The PHAs can either be homopolymers, copolymers, or terpolymers. In the case of copolymers or terpolymers, they can consist of different repeating units of formula (I), or of at least one repetitive unit of formula (I) in combination with at least one repetitive unit deriving from comonomers that are able to copolymerize with hydroxyalkanoates, such as lactones or lactams. In the latter case, the repeating units of formula (I) are present in an amount equal to at least 10% in moles with respect to the total moles of repetitive units.

Particularly preferred repeating units of formula (I) are those deriving from: 3-hydroxybutyrate, 3-hydroxyvalerate, 3-hydroxyhexanoate, 3-hydroxyoctanoate, 3-hydroxyundec-10-enoate, 4-hydroxyvalerate.

Particularly preferred PHAs are: polyhydroxybutyrate (PHB), poly-3-hydroxyvalerate (PHV), poly-3-hydroxyhexanoate (PHH), poly-3-hydroxyoctanoate (PHO), poly(3-hydroxybutyrate-co-3-hydroxyvalerate) (PHBV), poly(3-hydroxybutyrate-co-3-hydroxyhexanoate) (PHBH), poly(3-hydroxybutyrate-co-4-hydroxybutyrate), poly(3-hydroxyoctanoate-co-3-hydroxyundecen-10-enoate) (PHOU), poly(3-hydroxybutyrate-co-3-hydroxyvalerate-4-hydroxyvalerate) (PHBVV), polyhydroxybutyrate-hydroxyvalerate copolymer, or mixtures thereof.

According to the purposes of the present invention, particularly preferred PHAs are polyhydroxybutyrate (PHB) and poly(3-hydroxybutyrate-co-3-hydroxyvalerate) (PHBV).

Preferably, the PHA has a weight-average molecular weight ($M_w$) ranging from 10,000 to 1,000,000 Da.

As for the production of PHA, this is preferably achieved by microbial fermentation of an organic substrate (for example carbohydrates or other fermentable substrates, such as glycerol) through a strain of microorganisms capable of producing PHA, and subsequent recovery of PHA from the cell mass. For further details see, for example patent applications WO 99/23146, WO 2011/045625 and WO 2015/015395. Substrates suitable for the production of PHA by fermentation can be obtained in particular from the processing of vegetables, for example juices, molasses, pulps derived from the processing of sugar beet, sugar cane. These substrates generally contain, in addition to sucrose and other carbohydrates, organic growth factors, nitrogen, phosphorus and/or other minerals useful as nutrients for cell growth. An alternative is glycerol, a low-cost organic carbon source, being a by-product of biodiesel production, which can optionally be used in a mixture with levulinic acid (see, for example, U.S. Pat. No. 8,956,835 B2).

As regards the process for producing the filter element according to the present invention, it can be performed by machinery that is commonly used for cigarette manufacturing when the acetate cellulose fibers are bonded by triacetin. Initially, the bundle of cellulose acetate fibers is embedded with an aqueous suspension of the PHA. The use of an aqueous suspension of PHA is advantageous since the use of organic solvents for the PHA, such as chlorinated organic solvents (usually chloroform), is avoided, which are detrimental for the environment and may be too aggressive for the cellulose acetate fibers.

The embedding of the bundle can be performed according to known techniques, for instance by spraying the bundle with the PHA suspension, or by immersing the bundle in the PHA suspension. To achieve a regular bonding of the cellulose acetate fibers with the PHA, it is important to thoroughly and uniformly embed the bundle with the PHA suspension. The concentration of the PHA in the suspension is preferably from 1% to 20% w/v, more preferably from 5% to 15% w/v.

Then, the wet bundle is shaped in the form of a continuous elongated element, usually of a substantially cylindrical shape. The shaping may be performed by conventional machinery, as well known to cigarette manufacturers.

Subsequently, the continuous elongated element is heated to a temperature of from 140° C. to 180° C. for a time sufficient to melt the PHA and evaporate the water that derives from the PHA suspension. This step allows coating the cellulose acetate fibers with the PHA so as to achieve a firm bonding between the fibers when the PHA returns to the crystalline state.

Therefore, the heated continuous elongated element is cooled to obtain crystallization of the PHA. The so obtained elongated element is formed by the cellulose acetate fibers bonded by the PHA and has a relatively firm and rigid structure which is suitable for producing filter elements to be used in an industrial process for cigarette manufacturing. The cutting of the final elongated element can be performed according to techniques well known in the field of cigarette manufacturing.

The amount of PHA present in the final elongated element is selected so as to impart the desired hardness to the filter element and to retain a space between the fibers suitable for a correct pressure drop during smoking. Preferably, the amount of PHA in the filter element is from 5 to 30% by weight, preferably from 10 to 20% by weight, with respect to the total weight of the filter element.

The following examples are provided to further illustrate the invention.

EXAMPLES

Production of the Filter Element.

An aqueous suspension of poly(3-hydroxybutyrate-co-3-hydroxyvalerate (PHBV) (Mw: 700 KDa) at a concentration of 10% w/v, was sprayed on a bundle of cellulose acetate fibers by using an airbrush.

To produce specimens of the filter element to be used for the subsequent tests, the wet bundle of cellulose acetate fibers embedded by the PHBV suspension was inserted into a tube of PTFE (polytetrafluoroethylene) having a length of 20 cm and a diameter of 0.8 cm. The tube wall had passing holes of 0.26 mm diameter to promote evaporation of water during the subsequent heating.

The tube containing the wet bundle of cellulose acetate fibers was heated at 170° C. in an oven for 15 minutes, a time sufficient to melt the PHBV, but not to degrade the cellulose acetate.

Afterwards, the tube was removed from the oven and cooled at room temperature to obtain re-crystallization of the PHBV and to allow the binding of cellulose acetate fibers to one another.

Then, the filter rods were cut at different lengths (2.3 cm and 0.5 cm), and the amount of PHBV measured in the final filters was 10% by weight, with respect to the total weight of the filter.

The filters characterized by a length of 2.3 cm, a diameter of 0.8 cm, showed an average weight of 0.160 g, on the other hand the filters characterized by a length of 0.5 cm, a diameter of 0.8 cm, showed an average weight of 0.045 g.

Determination of ROS.

(a) Sampling System.

A computer-controlled Single Cigarette Smoking Machine (SCSM, CH Technologies) was used to generate mainstream smoke under standard smoking conditions (cigarettes burn for 8-9 min with a 2-s, 35-mL puff every minute) according to the Federal Trade Commission (FTC) protocol. Three impingers were filled with 20 mL of a 2',7'-dichlorofluorescin-horseradish peroxidase (DCFH-HRP) solution and used to collect gas-phase ROS for mainstream smoke. The experimental system is shown schematically in FIG. 1. Marlboro (red) cigarettes (without filter) were used to collect ROS from mainstream smoke.

In FIG. 1, the SCSM (1) is connected to the three impingers (2) containing the DCFH-HRP solution which receives the smoke produced by the cigarette (3) connected to the first impinger by means of a filter holder (4). The exhaust smoke exits the SCSM through a pipe (5). The SCSM is connected to a laptop (6) for data recordal and elaboration.

(b) Sample Preparation and Analysis.

Preparation of Fluorescent Probes and Standards for ROS in Cigarette Smoke.

The fluorescent probe used to determine ROS in this study was DCFH. A 1 mM stock solution was prepared by dissolving 2',7'-dichlorofluorescin diacetate (DCFH-DA; Calbiochem, USA) into ethyl alcohol (ACS grade, Pharmo, USA). A 10 mL solution was mixed with 40 mL 0.01 M sodium hydroxide (NaOH) and left in a dark room temperature for 30 min to hydrolyze. Then 200 mL of phosphate buffer, obtained by mixing sodium phosphate dibasic ($Na_2HPO_4$, Sigma Aldrich, MO, USA) with sodium phosphate dihydrogen phosphate anhydrous ($NaH_2PO_4$, Fluka, Germany) to achieve a pH of 7.2, was added to the solution. Horseradish peroxidase (HRP, Sigma Aldrich, USA) was used as the catalyst with a concentration of 0.5 units/mL. The final DCFH concentration of this working solution was 5 μM.

Equivalent $H_2O_2$ concentration was used to express the ROS concentrations by converting fluorescence intensity using a standard $H_2O_2$ calibration curve. Four $H_2O_2$ standards with the concentrations of 1.0, 2.0, 3.0, and $4.0\times10^{-7}$ nmol were prepared by mixing 0.1 mL hydrogen peroxide (ACS grade, Sigma Aldrich, USA) with 3 mL DCFH-HRP working solution. Standard blanks were obtained by mixing 0.1 mL deionized Milli-Q water (resistivity>18.2 MΩ) with probe. The standards were placed in cuvettes and incubated at 37° C. in a water bath. Formation of 2,7-dichlorofluorescin was monitored by measuring fluorescence (excitation wavelength: 504 nm; emission wavelength: 524 nm) using a Shimadzu Spectrophotometer (model: RF-5301 PC, Japan).

(c) Analysis of Reactive Oxygen Substances (ROS).

Subsequent to sampling, 3 mL of the reagent solution was removed from each impinger (each contains 20 mL), placed into a cuvette, and incubated for 15 min at 37° C. in water bath. Generally, the fluorescence intensities of the solutions in impingers were within the range of the standards. After using the volume of the solution to get the amount of ROS in each impinger, the contents of all three impingers were combined. An aliquot of the solution was taken and the fluorescence intensity was measured. Sampling blanks were obtained by operating the smoking system without any cigarette burning and analyzed in the same way. Sampling blank values were subtracted from sample results. The amount of ROS was measured also on the smoke produced by commercial cigarettes as reported in Table 1.

Further details about ROS analysis can be found in:

Jiayuan Zhao & Philip K. Hopke, "Concentration of Reactive Oxygen Species (ROS) in Mainstream and Sidestream Cigarette Smoke", Aerosol Science and Technology, 46:191-197, 2012;

Mohammad Arifur Rahman & Philip K. Hopke, "Assessment of Methods for the Measurement of Wood Fuel Compositions", Energy Fuels 2017, 31, 5, 5215-5221.

Determination of Pressure Drop and Hardness.

The samples of filter elements according to the present invention (Bio-on filters) were tested to measure pressure drop caused by the filter and hardness of the filter. The same measurements were made for the commercial cigarettes. Pressure drop was measured using Laminar Flow Element (Dwyer Instrument Inc., USA). Hardness was measured using Durometer, ASTM D2240 type A, ISO 868.

The results are reported in Table 1.

TABLE 1

| Samples | Average ROS * (nmol/cigarette) | Standard Deviation | Pressure Drop (Pascal) | Hardness (lb/inch$^2$) |
|---|---|---|---|---|
| No Filter | 120.0 | 2.5 | — | — |
| Commercial Marlboro Filter | 40.0 | 3.0 | 200.0 | 451 |
| Commercial Camel Filter | 37.0 | 0.9 | 174.2 | 475 |
| Commercial Newport Filter | 36.0 | 0.7 | 211.5 | 396 |
| Bio-on Filter - 2.7 cm | 19.9 | 1.9 | 81.1 | 252 |
| Bio-on Filter - 2.3 cm | 21.2 | 2.1 | 85.1 | 251 |
| Commercial HEET Malboro 0.5 cm (electronic cigarette) | 36.7 | 5.0 | 42 | 499 |
| Bio-on filter 0.5 cm | 11.7 | 3.9 | 20 | 240 |

* Detection limit: 1.5 nmol

Without being bound to any theory, the positive effect on ROS quenching by the presence of a PHA in the filter element is believed to be mainly due to the structure of the monomer unit —O—CHR$_1$—(CH$_2$)$_n$—CO—. The hydrogen linked to the ternary carbon atom —CHR$_1$— is particularly reactive with formation of a hydrogen radical that quenches the ROS, by inactivating the same via radical reaction.

The invention claimed is:

1. A process for producing a filter element suitable for use in smoking articles, the process comprising:

embedding a bundle of cellulose acetate fibers with an aqueous suspension of polyhydroxyalkanoate (PHA) to obtain a wet bundle of the cellulose acetate fibers covered by the aqueous suspension of the polyhydroxyalkanoate;

shaping the wet bundle in a form of a continuous elongated element;

heating the continuous elongated element to temperature greater than or equal to 140° C. and less than or equal to 180° C. for time sufficient to melt the polyhydroxyalkanoate and to evaporate water from the continuous elongated element;

cooling the heated continuous elongated element to obtain crystallization of the polyhydroxyalkanoate; and cutting the continuous elongated element into segments of predetermined length.

2. The process of claim 1, wherein the polyhydroxyalkanoate comprise poly(3-hydroxybutyrate-co-3-hydroxyvalerate-4-hydroxyvalerate) (PHBVV).

3. The process of claim 1, wherein the embedding of the bundle of the cellulose acetate fibers with the aqueous suspension of the polyhydroxyalkanoate comprises uniformly embedding the bundle of the cellulose acetate fibers with the aqueous suspension of the polyhydroxyalkanoate.

4. The process of claim 1, wherein the embedding of the bundle of the cellulose acetate fibers with the aqueous suspension of the polyhydroxyalkanoate comprises spraying the bundle of the cellulose acetate fibers with the aqueous suspension of the polyhydroxyalkanoate.

5. The process of claim 1, wherein the embedding of the bundle of the cellulose acetate fibers with the aqueous suspension of the polyhydroxyalkanoate comprises immersing the bundle of the cellulose acetate fibers in the aqueous suspension of the polyhydroxyalkanoate.

6. The process of claim 1, wherein a mass concentration of the polyhydroxyalkanoate in the aqueous suspension is greater than or equal to 1% weight per volume (% w/v) and less than or equal to 20% weight per volume (% w/v).

7. The process of claim 1, wherein a mass concentration of the polyhydroxyalkanoate in the aqueous suspension is greater than or equal to 5% weight per volume (% w/v) and less than or equal to 15% weight per volume (% w/v).

8. The process of claim 1, wherein prior to the embedding, the bundle of the cellulose acetate fibers has total denier greater than or equal to 20,000 denier and less than or equal to 80,000 denier.

9. The process of claim 1, wherein prior to the embedding, the bundle of the cellulose acetate fibers has total denier greater than or equal to 30,000 denier and less than or equal to 60,000 denier.

10. The process of claim 1, wherein the polyhydroxyalkanoate has a weight-average molecular weight ($M_w$) greater than or equal to 10,000 daltons (Da) and less than or equal to 1,000,000 daltons (Da).

11. The process of claim 1, wherein the polyhydroxyalkanoate is present in an amount greater than or equal to 5% by weight and less than or equal to 30% by weight with respect to a total weight of the filter element.

12. The process of claim 1, wherein the polyhydroxyalkanoate is present in an amount greater than or equal to 10% by weight and less than or equal to 20% by weight with respect to a total weight of the filter element.

13. The process of claim 1, wherein the cellulose acetate fibers have diameter, expressed as denier per filament (dpf), greater than or equal to 1 and less than or equal to 15.

14. The process of claim 1, wherein the cellulose acetate fibers have diameter, expressed as denier per filament (dpf), greater than or equal to 5 and less than or equal to 10.

15. The process of claim 1, wherein the polyhydroxyalkanoate comprises at least one homopolymer.

16. The process of claim 1, wherein the polyhydroxyalkanoate comprises at least one copolymer.

17. The process of claim 1, wherein the polyhydroxyalkanoate comprises at least one terpolymer.

18. The process of claim 1, wherein the polyhydroxyalkanoate comprises polyhydroxybutyrate (PHB), poly-3-hydroxyvalerate (PHV), poly-3-hydroxyhexanoate (PHH), poly-3-hydroxyoctanoate (PHO), poly(3-hydroxybutyrate-co-3-hydroxyvalerate) (PHBV), poly(3-hydroxybutyrate-co-3-hydroxyhexanoate) (PHBH), poly(3-hydroxybutyrate-co-4-hydroxybutyrate), poly(3-hydroxyoctanoate-co-3-hydroxyundecen-10-enoate) (PHOU), poly(3-hydroxybutyrate-co-3-hydroxyvalerate-4-hydroxyvalerate) (PHBVV), polyhydroxybutyrate-hydroxyvalerate copolymer, or mixtures thereof.

19. The process of claim 1, wherein the polyhydroxyalkanoate comprises polyhydroxybutyrate (PHB).

20. The process of claim 1, wherein the polyhydroxyalkanoate comprises poly(3-hydroxybutyrate-co-3-hydroxyvalerate) (PHBV).

* * * * *